US009707586B2

(12) United States Patent
Rivas et al.

(10) Patent No.: US 9,707,586 B2
(45) Date of Patent: Jul. 18, 2017

(54) PRINTHEAD WITH RECESSED SLOT ENDS

(75) Inventors: Rio Rivas, Corvallis, OR (US); Ed Friesen, Corvallis, OR (US); Terry McMahon, Albany, OR (US); Donald W. Schulte, Albany, OR (US); David Douglas Hall, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 105 days.

(21) Appl. No.: 14/374,160

(22) PCT Filed: Mar. 16, 2012

(86) PCT No.: PCT/US2012/029387

§ 371 (c)(1),
(2), (4) Date: Jul. 23, 2014

(87) PCT Pub. No.: WO2013/137902

PCT Pub. Date: Sep. 19, 2013

(65) Prior Publication Data

US 2015/0001316 A1 Jan. 1, 2015

(51) Int. Cl.
*B44C 1/22* (2006.01)
*B05B 15/06* (2006.01)
(Continued)

(52) U.S. Cl.
CPC ..... *B05B 15/06* (2013.01); *B41J 2/14145* (2013.01); *B41J 2/1603* (2013.01); *B41J 2/1628* (2013.01);
(Continued)

(58) Field of Classification Search
CPC .. B41J 2202/22; B41J 2/1629; B41J 2/14201; B41J 2/1628; H05K 2201/09827; H05K 3/06
(Continued)

(56) References Cited

U.S. PATENT DOCUMENTS 6,648,454 B1 11/2003 Donaldson
6,805,432 B1 * 10/2004 Milligan ..... B41J 2/1603 347/59
(Continued)

FOREIGN PATENT DOCUMENTS

CN 1926056 3/2007
JP 2000351214 12/2000
(Continued)

OTHER PUBLICATIONS

International Search Report, dated Nov. 5, 2012 for PCT/US2012/029387, filed Mar. 16, 2012, 10 pages, English.

*Primary Examiner* — Binh X Tran
(74) *Attorney, Agent, or Firm* — HP Inc.—Patent Department

(57) ABSTRACT

In an embodiment, a method of forming a printhead includes forming on a front-side surface of a substrate, a thin film layer and a plurality of fluidic channels and ejection chambers. The method also includes forming a slot through the substrate from the back-side surface to the front-side surface, where the back-side and front-side surfaces generally oppose one another. The slot has a length extending along a long axis of the substrate and a width extending along a short axis of the substrate. The method includes forming recessed regions into the back-side surface of the substrate at both ends of the slot that extend beyond the length of the slot.

20 Claims, 14 Drawing Sheets

(51) Int. Cl.
*B41J 2/16* (2006.01)
*B41J 2/14* (2006.01)

(52) U.S. Cl.
CPC ..... *B41J 2/1629* (2013.01); *B41J 2/1631* (2013.01); *B41J 2/1634* (2013.01); *B41J 2/1642* (2013.01); *Y10T 29/49401* (2015.01)

(58) Field of Classification Search
USPC ..... 216/17, 19, 27, 39; 438/725
See application file for complete search history.

(56) References Cited

U.S. PATENT DOCUMENTS 6,910,758 B2 * 6/2005 Truninger ..... B41J 2/1603 347/47
6,916,090 B2 * 7/2005 Valley ..... B41J 2/14145 347/93
2004/0031151 A1 2/2004 Buswell et al.
2004/0252166 A1 12/2004 Conta
2005/0083372 A1 * 4/2005 Obert ..... B41J 2/1404 347/47
2005/0088477 A1 * 4/2005 Horn ..... B41J 2/1603 347/20
2005/0236358 A1 * 10/2005 Buswell ..... B24B 1/04 216/2
2007/0064060 A1 * 3/2007 Gu ..... B41J 2/1404 347/65
2010/0323526 A1 12/2010 Kishimoto

FOREIGN PATENT DOCUMENTS

JP 2005225147 8/2005
JP 2005254749 9/2005
JP 2006281715 10/2006
JP 2007136875 6/2007
TW 200406313 11/2006

* cited by examiner

PRINTHEAD WITH RECESSED SLOT ENDS

CROSS-REFERENCE TO RELATED APPLICATION

Pursuant to 35 U.S.C. §371, this application is a United States National Stage Application of International Patent Application No. PCT/US2012/029387, filed on Mar. 16, 2012, the contents of which are incorporated by reference as if set forth in their entirety herein.

BACKGROUND

Fluid ejection devices such as printheads in inkjet printing systems typically use thermal resistors or piezoelectric material membranes as actuators within fluidic chambers to eject fluid drops (e.g., ink) from nozzles. In either case, fluid flows from a reservoir into the fluidic chambers through a fluid slot that extends through a substrate on which the chambers and actuators are generally formed. Advancements in slotting technology have enabled narrower slots which provide significant economic advantages. One tradeoff to the narrower slots and the shrinking of other feature dimensions within the printhead, however, is an increase in substrate fragility. For example, these smaller dimensions can result in cracks in silicon substrates that originate from the slot ends on the back side of the substrate.

BRIEF DESCRIPTION OF THE DRAWINGS

The present embodiments will now be described, by way of example, with reference to the accompanying drawings, in which.

DETAILED DESCRIPTION

Overview

As noted above, improved techniques for fabricating slots in substrates of fluid ejection devices (e.g., printheads) have enabled narrower slots. In general, printhead features such as fluid drop ejection actuators (e.g., thermal resistors, piezoelectric membranes), fluidic firing chambers, and fluidic conduits (including fluid slots) that route fluid from supply reservoirs to the firing chambers, are fabricated using a mixture of integrated circuit and MEMS techniques. Improved fluid slot fabrication processes that enable narrower slots include, for example, the use of fluorine-based chemistries for plasma etching of Si (silicon) and laser machining.

While the narrower slots provide various economic advantages, they can also contribute to increased fragility of the printhead substrate. The narrower slots enable a decrease in dimensions of other printhead features such as the slot pitch, the outer rib and the adhesive bond lines. Increased fragility in the printhead substrate from the narrowed slots and related dimensional decreases usually manifests as cracks in the silicon substrates. Such cracks often originate from the slot ends on the backside of the substrate.

Embodiments of the present disclosure provide a slot design and methods of fabrication for a narrow slot that result in a substrate with increased strength. The disclosed slot design and methods increase the back side substrate strength while maintaining front side substrate strength and enabling narrow slot geometries and a tight slot pitch. The increase in substrate strength reduces cracks originating at the slot ends in the back side of the substrate. This solution improves printhead fabrication line yield and overall product reliability in fluid ejection systems such as inkjet printers.

In one example embodiment, a method of forming a printhead includes forming a thin film layer and a plurality of fluidic channels and ejection chambers on the front side surface of a substrate. The method also includes forming a slot through the substrate from the back-side surface to the front-side surface. The back-side and front-side surfaces generally oppose one another, and the slot formed through the substrate has a length that extends along a long axis of the substrate and a width that extends along a short axis of the substrate. The method includes forming recessed regions into the back-side surface of the substrate at both ends of the slot. The recessed regions extend beyond the length of the slot.

In another example embodiment, a printhead includes a substrate that has generally opposing front and back surfaces. The printhead includes a slot extending through the substrate between the back and front surfaces and along a long axis of the substrate. At each end of the slot the substrate includes a recessed end region formed into the back surface.

Illustrative Embodiments

Figure 1:
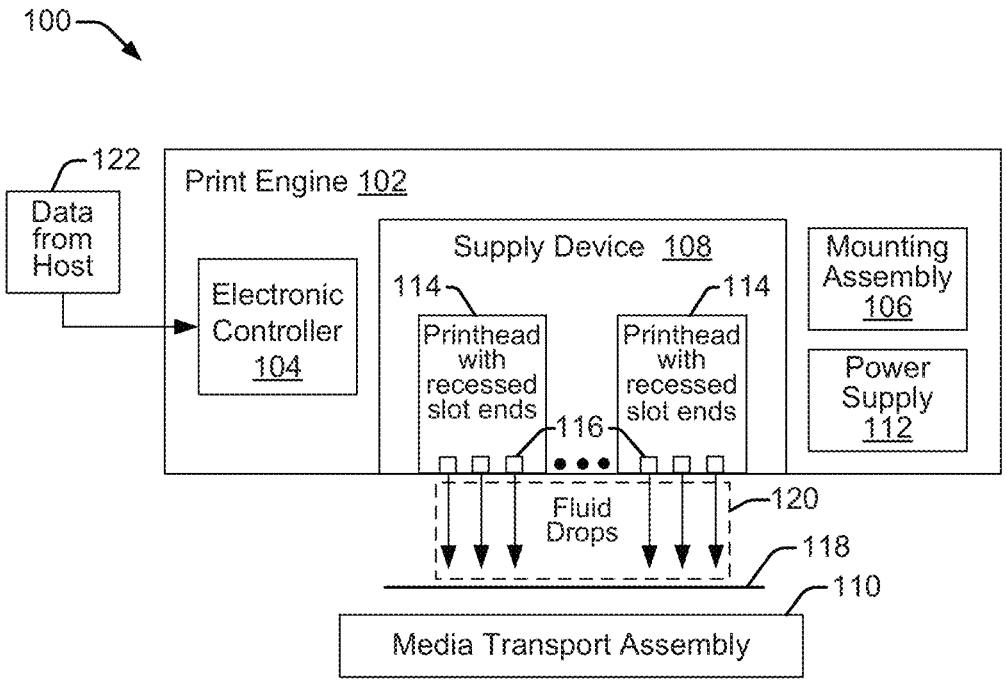
FIG. 1 shows a block diagram of an inkjet printing system suitable for implementing a fluid ejection device having a substrate with recessed slot ends, according to an embodiment.

FIG. 1 shows a block diagram of an inkjet printing system 100 suitable for implementing a fluid ejection device (e.g., a printhead) having a substrate with recessed slot ends as disclosed herein, according to an embodiment of the disclosure. In one embodiment, the inkjet printing system 100 includes a print engine 102 having a controller 104, a mounting assembly 106, one or more replaceable supply devices 108 (e.g., print cartridges), a media transport assembly 110, and at least one power supply 112 that provides power to the various electrical components of inkjet printing system 100. The inkjet printing system 100 further includes one or more printheads 114 (fluid ejection devices) that eject droplets of ink or other fluid through a plurality of nozzles 116 (also referred to as orifices or bores) toward print media 118 so as to print onto the media 118. In some embodiments a printhead 114 may be an integral part of an ink cartridge supply device 108, while in other embodiments a printhead 114 may be mounted on a print bar (not shown) of mounting assembly 106 and coupled to a supply device 108 (e.g., via a tube). Print media 118 can be any type of suitable sheet or roll material, such as paper, card stock, transparencies, Mylar, polyester, plywood, foam board, fabric, canvas, and the like.

In the present embodiment, as generally discussed below with regard to FIGS. 1-15, printhead 114 comprises a thermal inkjet (TIJ) printhead that ejects fluid drops from a nozzle 116 by passing electrical current through a thermal resistor ejection element to generate heat and vaporize a small portion of the fluid within a firing chamber. However, printhead 114 is not limited to being implemented as a TIJ printhead. In other embodiments, for example, printhead 114 can be implemented as a piezoelectric inkjet (PIJ) printhead that uses a piezoelectric material ejection element to generate pressure pulses to force fluid drops out of a nozzle 116. In any case, as discussed in greater detail below, printhead 114 is designed and fabricated to include fluid-handling slots that have recessed regions at the ends of the slots. Nozzles 116 are typically arranged in one or more columns or arrays along printhead 114 such that properly sequenced ejection of ink from the nozzles causes characters, symbols, and/or other graphics or images to be printed on print media 118 as printhead 114 and print media 118 are moved relative to each other.

Mounting assembly 106 positions printhead 114 relative to media transport assembly 110, and media transport assembly 110 positions print media 118 relative to printhead 114. Thus, a print zone 120 is defined adjacent to nozzles 116 in an area between printhead 114 and print media 118. In one embodiment, print engine 102 is a scanning type print engine. As such, mounting assembly 106 includes a carriage for moving printhead 114 relative to media transport assembly 110 to scan print media 118. In another embodiment, print engine 102 is a non-scanning type print engine. As such, mounting assembly 106 fixes printhead 114 at a prescribed position relative to media transport assembly 110 while media transport assembly 110 positions print media 118 relative to printhead 114.

Electronic controller 104 typically includes components of a standard computing system such as a processor, memory, firmware, and other printer electronics for communicating with and controlling supply device 108, printhead(s) 114, mounting assembly 106, and media transport assembly 110. Electronic controller 104 receives data 122 from a host system, such as a computer, and temporarily stores the data 122 in a memory. Data 122 represents, for example, a document and/or file to be printed. As such, data 122 forms a print job for inkjet printing system 100 that includes one or more print job commands and/or command parameters. Using data 122, electronic controller 104 controls printhead 114 to eject ink drops from nozzles 116 in a defined pattern that forms characters, symbols, and/or other graphics or images on print medium 118.

Figure 2:
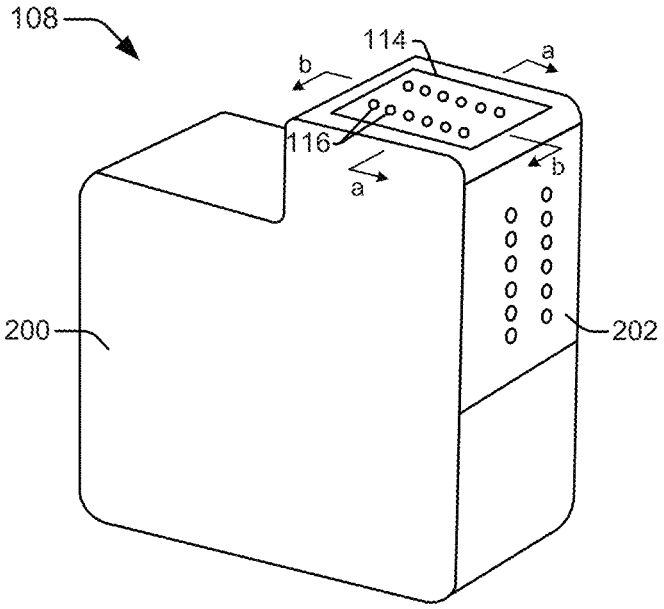
FIG. 2 shows an example of fluid supply device implemented as a print cartridge that can be used in an exemplary printing system, according to an embodiment.

FIG. 2 shows an example of fluid supply device 108 implemented as a print cartridge 108 that can be used in an exemplary printing system 100, according to an embodiment of the disclosure. The print cartridge 108 is generally comprised of a cartridge body 200, printhead 114, and electrical contacts 202. The cartridge body 200 supports the printhead 114 and electrical contacts 202 through which electrical signals are provided to activate ejection elements (e.g., resistive heating elements) that eject fluid drops from selected nozzles 116. Fluid within cartridge 108 can be any suitable fluid used in a printing process, such as various printable fluids, inks, pre-treatment compositions, fixers, and the like. In some examples, the fluid can be a fluid other than a printing fluid. A cartridge 108 typically contains its own fluid supply within cartridge body 200, but it may also receive fluid from an external supply (not shown) such as a fluid reservoir connected through a tube, for example. Ink cartridge supply devices 108 containing their own fluid supplies are generally disposable once the fluid supply is depleted.

Figure 3:
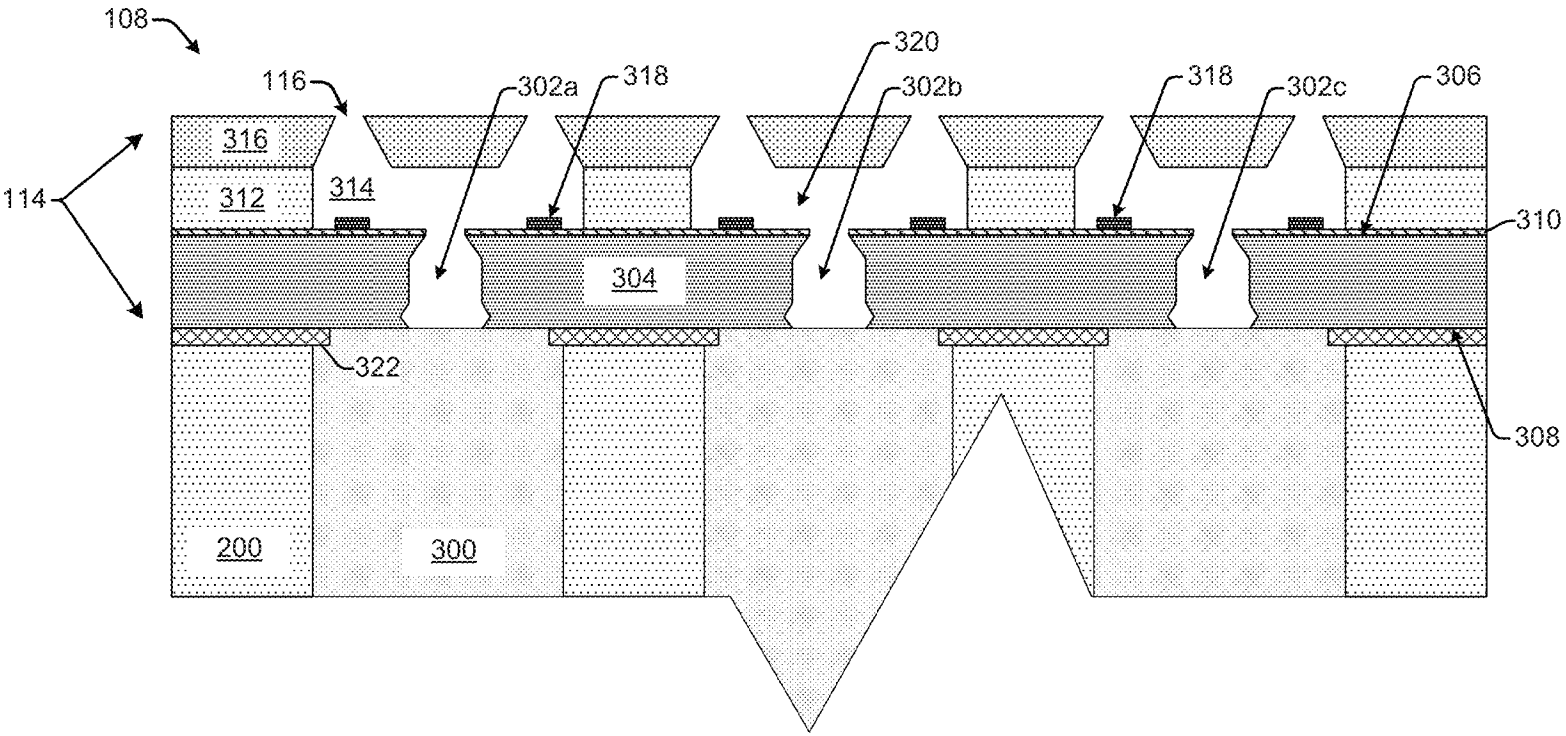
FIG. 3 shows a cross-sectional view of a portion of the exemplary print cartridge taken along line a-a in FIG. 2, according to an embodiment.

FIG. 3 shows a cross-sectional view of a portion of the exemplary print cartridge 108 taken along line a-a in FIG. 2. The cartridge body 200 contains fluid 300 for supply to printhead 114. In this implementation the print cartridge 108 supplies one color of fluid or ink to the printhead 114. However, in other implementations, other print cartridges can supply multiple colors and/or black ink to a single printhead. Fluid-handling slots 302 (302*a*, 302*b*, and 302*c*) pass through the printhead substrate 304. While three slots are shown, a greater or lesser number of slots may be used in different printhead implementations. Substrate 304 is typically formed of silicon, and in some implementations may comprise a crystalline substrate such as doped or non-doped monocrystalline silicon or doped or non-doped polycrystalline silicon. Other examples of suitable substrates include gallium arsenide, gallium phosphide, indium phosphide, glass, silica, ceramics, or a semiconducting material. Substrate 304 is on the order of between 100 and 2000 microns thick, and in one implementation is approximately 675 microns thick. Substrate 304 has a front-side surface 306 and a back-side surface 308 that generally oppose one another. Adhesive layer 322 adjoins substrate 304 at back-side surface 308 to cartridge body 200. Adhesive layer 322 can apply stress to backside surface 308 and put it into tension, which promotes backside silicon cracks and leads to substrate fragility. A thin film layer 310 (or layers 310) is formed over the front-side surface 306 and comprises, for example, a field or thermal oxide layer.

A barrier layer 312 is formed over the thin film layer 310, and at least partially defines firing or ejection chambers 314. The barrier layer 312 can comprise, for example, a photo-imageable epoxy. Over the barrier layer 312 is an orifice plate or nozzle plate 316 having nozzles 116 through which fluid is ejected. The orifice plate may comprise, for example, a photo-imageable epoxy or a nickel substrate. In some implementations, the orifice plate is the same material as the barrier layer 312, and in other implementations the orifice plate and barrier layer 312 may be integral. Within each ejection chamber 314 and surrounded by barrier layer 312, is an independently controllable fluid ejection element 318. In the illustrated embodiment, the fluid ejection elements comprise thermal firing resistors 318. When an electrical current is passed through the resistor 318 in a given ejection chamber 314, a small portion of the fluid is heated to its boiling point so that it expands to eject another portion of the fluid through the nozzle 116. The ejected fluid is then replaced by additional fluid from the fluid-handling passageway 320 and slot 302. As noted above, in different implementations fluid ejection elements can comprise piezoelectric material ejection elements (actuators).

FIGS. 4-7 show an exemplary process for forming fluid-handling slots having recessed end regions in a substrate of printhead 114, according to an embodiment of the disclosure. FIGS. 4*a* and 4*b* show partial cross-sectional views of a portion of the printhead 114 of exemplary print cartridge 108 taken along lines a-a and b-b in FIG. 2. More specifically, FIG. 4*a* shows the cross-sectional view along lines a-a, which is the short axis view of the printhead 114, while FIG. 4*b* shows the cross-sectional view along lines b-b, which is the long axis view of the printhead 114. The long axis view shown in FIG. 4*b* is facilitated by the break lines drawn through the middle of the view (i.e., the open wavy lines with blank space in between), which are intended to indicate that the length of the long axis view is proportionally greater than it appears in the figure. This also applies to subsequent figures showing the long axis view.

Figure 4B:
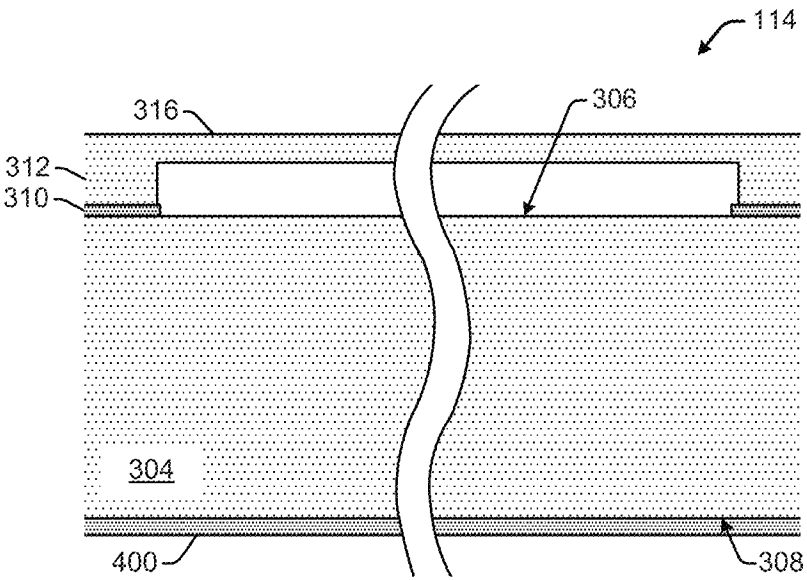
FIGS. 4-7 show an exemplary process for forming fluid-handling slots having recessed end regions in a substrate of printhead, according to an embodiment.
Figure 4A:
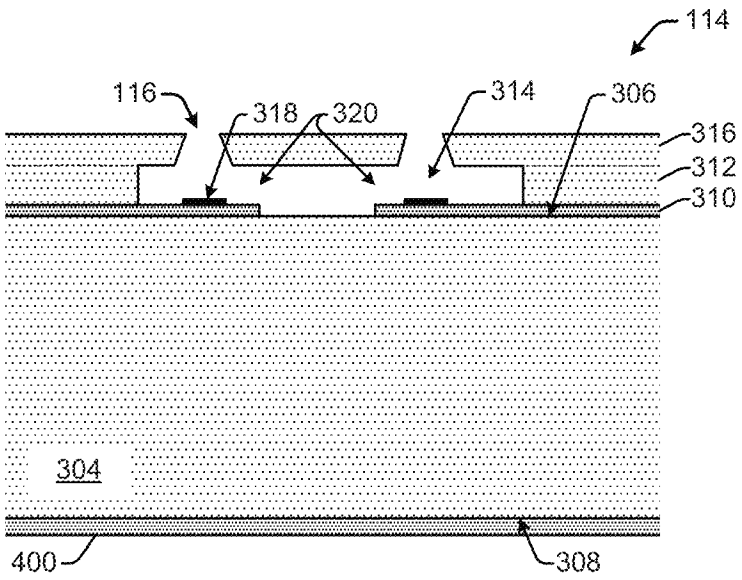

As shown in FIGS. 4*a* and 4*b*, initial steps in an exemplary process of forming fluid-handling slots having recessed end regions in a printhead 114, include processing the front-side surface of substrate 304. This processing includes forming over the front-side surface 306, a thin film layer 310, barrier layer 312, orifice layer 316 with nozzles 116, chambers 314 with ejection elements 318, and fluid passageways 320. Additionally, a wet etch masking layer 400 is formed over the back-side surface 308 of substrate 304. The masking layer 400 can comprise a hard mask made of any suitable material that is resistant to etching environments and that will not be removed by solvents used to remove photoresist materials during a slotting process. For example, the hard mask can be a grown thermal oxide, or a grown or deposited dielectric material such as CVD (chemical vapor deposition) oxides, silicon oxide formed with a TEOS precursor (tetraethoxysilane), silicon carbide, silicon nitride, and/or other suitable materials such as aluminum, tantalum, copper, aluminum-copper alloys, aluminum-titanium alloys, and gold.

Figure 5B:
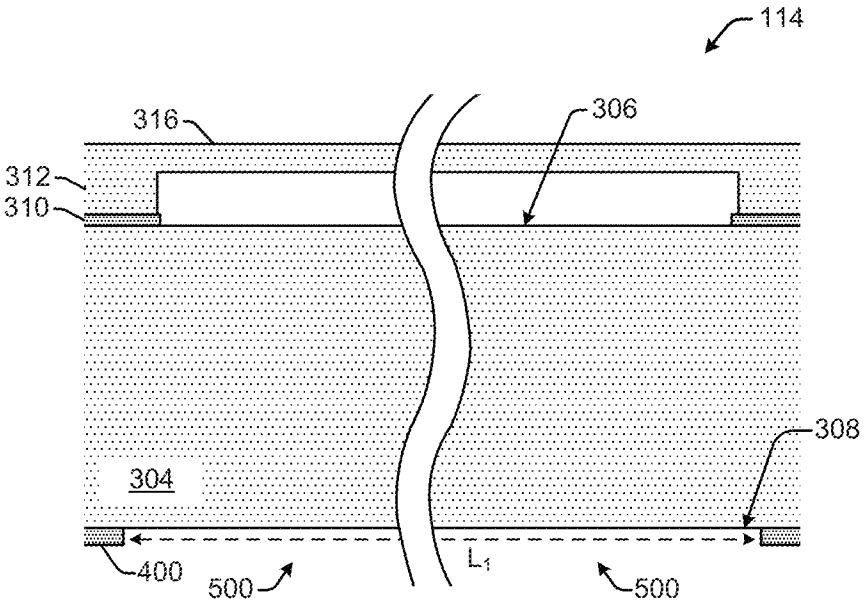
Figure 5A:
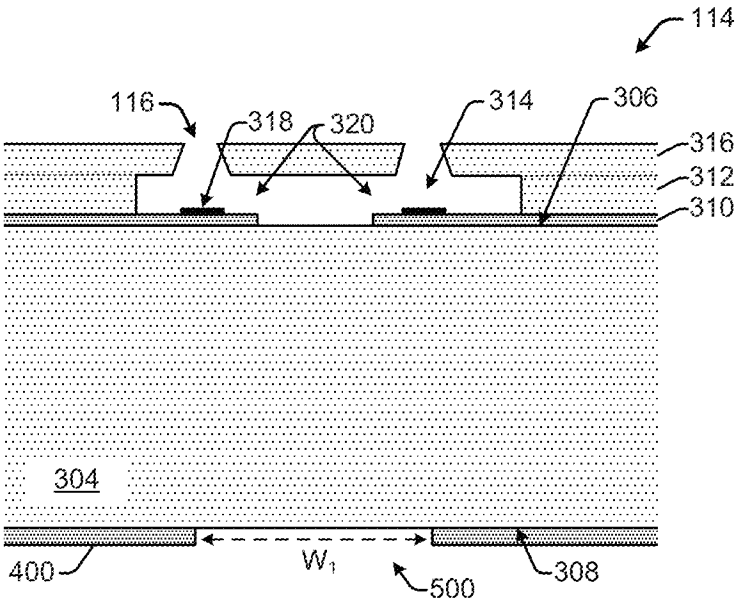
Figure 7B:
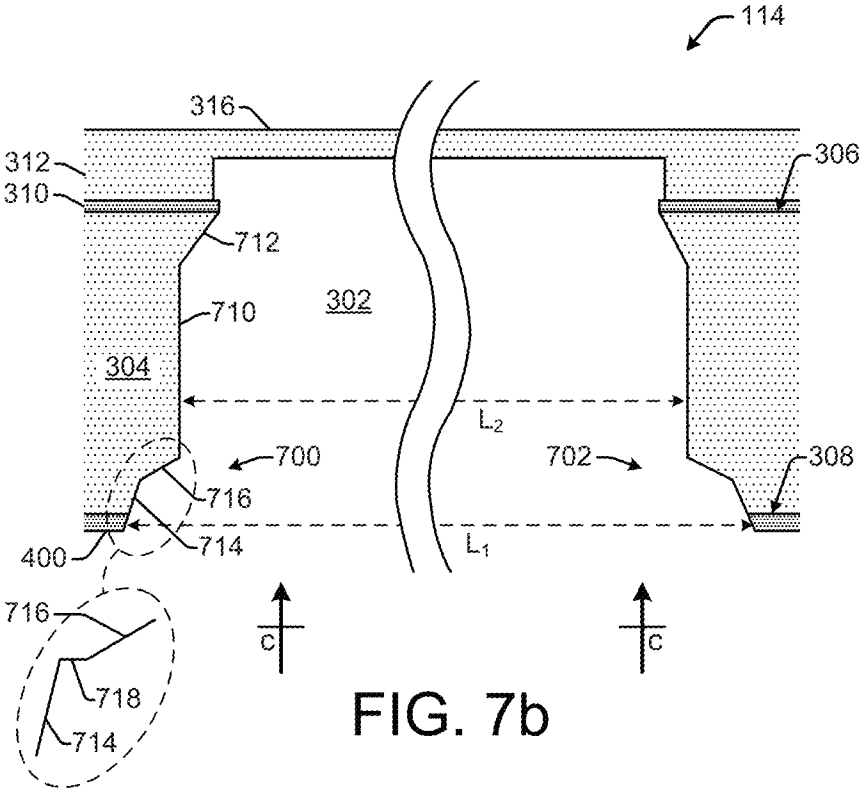
Figure 7A:
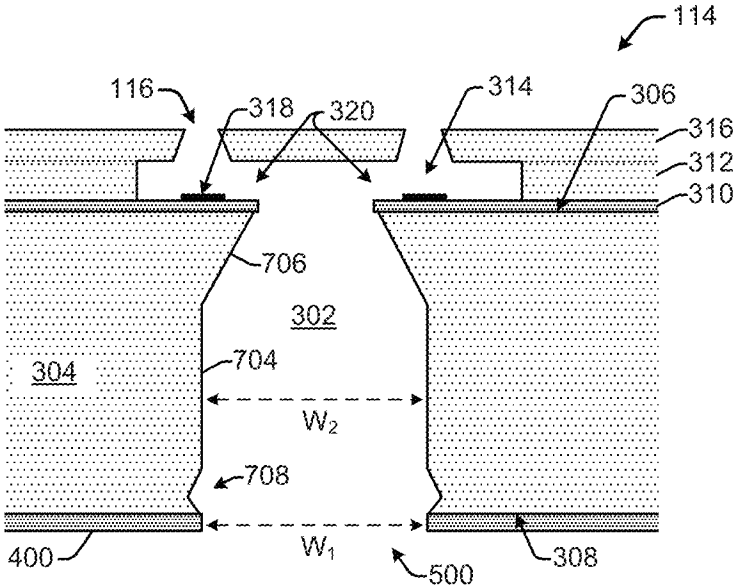

FIGS. 5*a* and 5*b* show additional steps in an exemplary process of forming fluid-handling slots having recessed end regions in a printhead 114. FIG. 5*a* shows the cross-sectional, short axis view of printhead 114 taken along lines a-a of FIG. 2, while FIG. 5*b* shows the cross-sectional, long axis view taken along lines b-b of FIG. 2. As shown in FIGS. 5*a* and 5*b*, the masking layer 400 is patterned to create an exposed area 500 of the back-side surface 308 of substrate 304. In one example implementation, the masking layer 400 is patterned using a laser machining process. However, other suitable patterning processes may also be used, such as a photolithographic process with a dry or wet etch to remove the hard mask material. The exposed area 500 of the back-side surface 308 has a width $W_1$ that corresponds with the short axis of printhead 114 shown in FIG. 5*a*, and a length $L_1$ that corresponds with the long axis of printhead 114 shown in FIG. 5*b*. Referring additionally now to FIGS. 7*a* and 7*b*, the width $W_1$ of exposed area 500 can correspond approximately with the width $W_2$ of a desired slot 302 as shown in FIG. 7*a*. In other implementations, the width $W_1$ of exposed area 500 can be greater than the width $W_2$ of a desired slot 302 as shown in FIG. 7*a*, and in some implementations it may be in the range of about 100 to about 1000 microns. The length $L_1$ of exposed area 500, however, corresponds to a length that is greater than the length $L_2$ of a desired slot 302 as shown in FIG. 7*b*. That is, the length $L_1$ of exposed area 500 in any case, will be longer than the length $L_2$ of a desired slot 302, such that the length $L_1$ extends beyond both ends of the slot 302. As noted below, the additional length $L_1$ of the exposed area 500 beyond the ends of the slot 302 facilitates the formation of the recessed regions at the ends of the slot in a subsequent etching process. Thus, the exposed area 500 encompasses not only the length $L_2$ and width $W_2$ of the slot 302, but also encompasses the recessed regions at both ends of the slot.

Figure 6B:
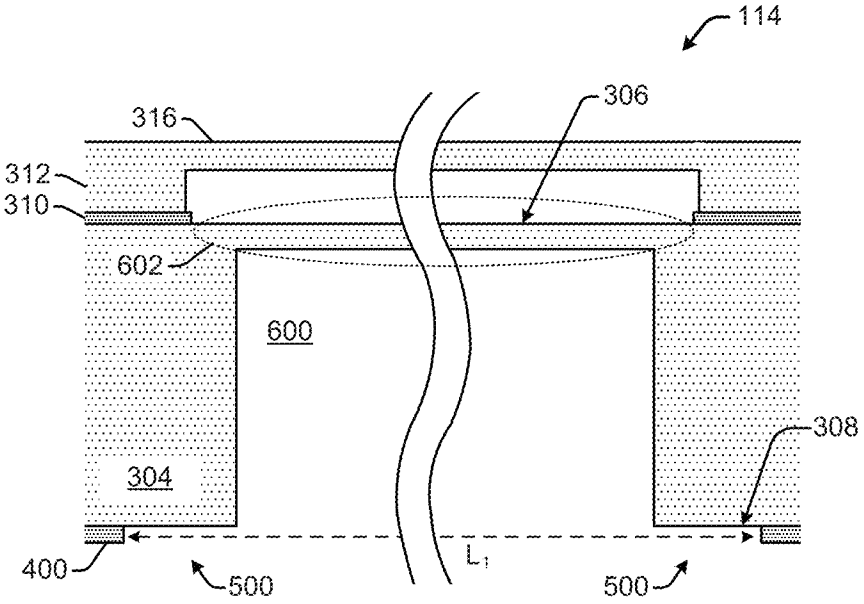
Figure 6A:
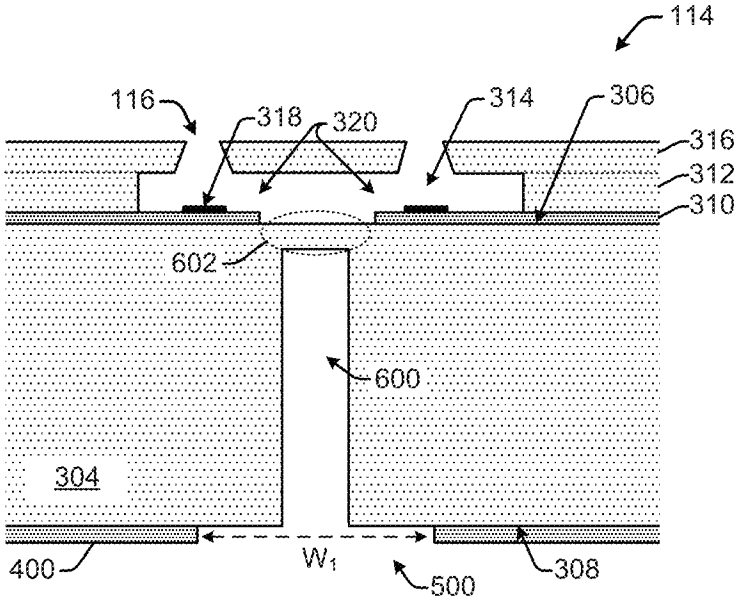

FIGS. 6*a* and 6*b* show additional steps in an exemplary process of forming fluid-handling slots having recessed end regions in a printhead 114. FIG. 6*a* shows the cross-sectional, short axis view of printhead 114 taken along lines a-a of FIG. 2, while FIG. 6*b* shows the cross-sectional, long axis view taken along lines b-b of FIG. 2. As shown in FIGS. 6*a* and 6*b*, substrate material (e.g., silicon) is removed at the back-side surface 308 to form a deep trench 600 (i.e., which is a portion of the slot) in the substrate 304. In one implementation, the trench 600 is formed using a laser machining process. Other suitable techniques for forming the trench 600 include, for example, silicon dry etch with plasma enhanced reactive ion etch (RIE) with alternating sulfur hexafluoride (SF6) etching and octafluorobutene (C4F8) deposition, sand drilling and mechanically contacting the substrate material. Mechanically contacting can include, for example, sawing with a diamond abrasive blade. The trench 600 is formed through less than the entire thickness of the substrate 304, which leaves a membrane 602 (e.g., a silicon membrane) to protect the thin film layer(s) 310 from the potentially damaging effects of the laser beam or other trench formation processes.

FIGS. 7*a* and 7*b* show additional steps in an exemplary process of forming fluid-handling slots having recessed end regions in a printhead 114. FIG. 7*a* shows the cross-sectional, short axis view of printhead 114 taken along lines a-a of FIG. 2, while FIG. 7*b* shows the cross-sectional, long axis view taken along lines b-b of FIG. 2. As shown in FIGS. 7*a* and 7*b*, additional substrate material is removed from within the trench 600 (see FIGS. 6*a*, 6*b*) to form slot 302 all the way through the substrate 304 from the back-side surface 308 through the front-side surface 306. In addition, as shown in the long axis view of FIG. 7*b*, substrate material is removed from portions of the exposed area 500 (see FIGS. 6*a*, 6*b*) that extend beyond the ends of the slot 302 to form the recessed regions 700 and 702 into the back-side surface 308 of the substrate 304 at the ends of the slot 302. The recessed regions 700 and 702 extend beyond the length $L_2$ of the slot 302. In one implementation, the removal of additional substrate material is achieved using an anisotropic wet etch process. Wet etching is achieved by immersing the substrate 304 into an anisotropic etchant for a period of time sufficient to form the slot 302 and the recessed regions at the slot ends. In one implementation, the substrate 302 can be immersed in an etchant such as TMAH (TetramethylamoniumHydroxide) or KOH (potassium hydroxide), for a period of 1 to 3 hours. Etchants can include any anisotropic wet etchant that has selectivity to hard masks and exposed thin film and other layers. In one implementation, a single instance of wet etching is used to remove additional substrate material, forming the slot 302 and recessed regions 700 and 702. In other implementations, wet etching can comprise multiple instances of wet etching.

The slot 302 is generally defined by sidewalls that are substantially symmetric from one side of the substrate 304 to the other side as shown in the short axis view (FIG. 7*a*), and from one end to the other end of the substrate 304 as shown in the long axis view (FIG. 7*b*). As shown in FIG. 7*a*, a sidewall in the short axis includes a middle portion 704 that is generally perpendicular to the front- and back-side surfaces 306, 308. The middle portion 704 of the sidewall comprises the <110> plane of the silicon substrate which etches the fastest in the anisotropic wet etch. An upper portion or plane 706 of the short axis sidewall has a steep angle because it comprises the <111> plane of the silicon substrate which etches more slowly than the <110> plane. The sidewall of slot 302 in the short axis view also includes a "fang" feature 708 next to the back-side surface 308. The short axis fangs 708 are formed during the fabrication of the slot by the relationship dimension of the masking layer 400 width relative to the deep laser machined location and the wet etch time.

As shown in FIG. 7*b*, a sidewall in the long axis includes a middle portion 710 that is generally perpendicular to the front- and back-side surfaces 306, 308. The middle portion 710 of the sidewall comprises the <110> plane of the silicon substrate which etches the fastest in the anisotropic wet etch. An upper portion 712 of the long axis sidewall has a steep angle because it comprises the <111> plane of the silicon substrate which etches more slowly than the <110> plane. The sidewall of slot 302 in the long axis view also includes the recessed regions 700 and 702. As shown in FIG. 7*b*, recessed regions 700 and 702 at the ends of the slot 302 include differently angled portions or planes. In one implementation, a first portion or plane 714 of a recessed region is steeply angled because it comprises the <111> plane of the silicon substrate which etches more slowly than the <110> plane. A second portion or plane 716 of a recessed region has a lower angle because it comprises the <311> plane of the silicon substrate which etches the slowest in the anisotropic wet etch. The <311> plane is formed due to the non isotropic etch proceeding from the adjacent <110> plane 710. In other implementations, such as that shown in the dotted line cutout of FIG. 7*b*, additional variations are possible in the planar configuration of the recessed regions 700, 702. For example, as shown in the dotted line cutout, a <100> horizontal plane 718 is formed between the first 714 and second 716 planes of the recessed region. These etch features are formed during the fabrication of the slot by the relationship dimension of the masking layer 400 width relative to the deep laser machined location and the wet etch time.

Figure 8A:
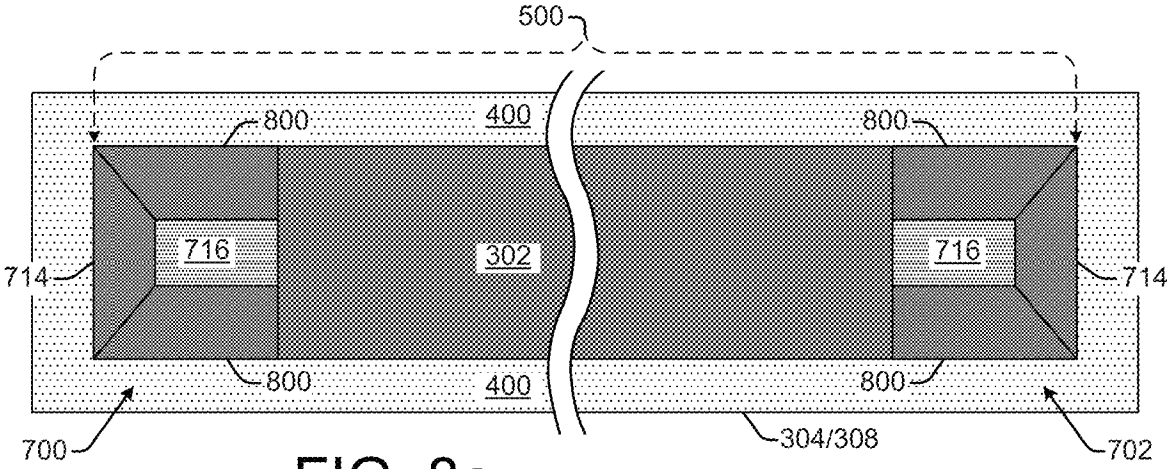
FIGS. 8*a* and 8*b* show plan views from the back side of a substrate illustrating exemplary recessed regions, according to embodiments.
Figure 8B:
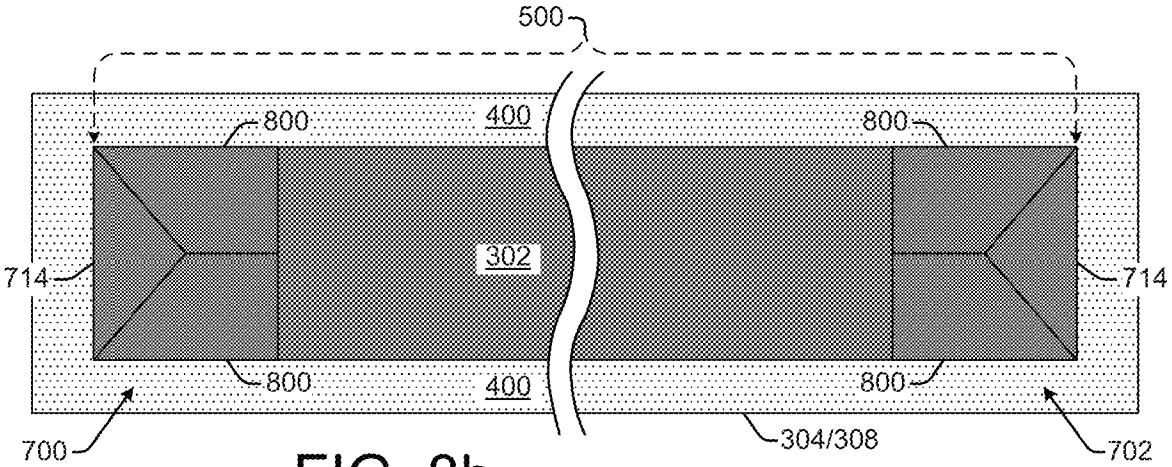

FIGS. 8*a* and 8*b* show plan views from the back side of the substrate 304 taken from the perspective of the arrows labeled "c" in FIG. 7*b*, illustrating exemplary recessed regions 700, 702, according to embodiments of the disclosure. The area shown in FIGS. 8*a* and 8*b* surrounded by masking layer 400 includes the exposed area 500 of the back-side surface 308 of substrate 304 previously patterned (e.g., laser machined) into the masking layer 400 as discussed above regarding FIGS. 5*a* and 5*b*. Thus, the exposed area 500 encompasses both the slot opening at the back-side surface 308 of substrate 304 and the recessed regions 700, 702, formed in the back-side surface 308 of substrate 304. In FIG. 8*a*, each of the planes 714 and 800 comprises the <111> plane of the silicon substrate 304. Plane 714 is the same 714 plane shown in FIG. 7*b*. Planes 714 and 800 slope into the substrate 304 (and into the page, from the reader's perspective) away from the underlying back-side surface 308 (not shown) and masking layer 400 (i.e., away from the perimeter of exposed area 500). Plane 716 is the same 716 plane shown in FIG. 7*b*. Plane 716 is fully recessed into the substrate 304 and slopes toward the slot 302. Thus, in the implementation shown in FIG. 8*a*, the recessed regions 700, 702, at the slot ends form a type of sloped "bathtub" having an open end facing the slot 302.

As noted above, the etch features of the recessed regions 700, 702 are formed during the fabrication of the slot by the relationship dimension of the masking layer 400 width relative to the deep laser machined location and the wet etch time. Thus, various other planar configurations are possible. FIG. 8*b*, for example, illustrates an additional configuration of recessed regions 700, 702 that forms a type of "trough" that slopes toward the slot 302. Here, the wet etching results in the 714 and 800 planes intersecting at the bottom of the trough, without the formation of the 716 plane shown in FIG. 8*a*.

FIGS. 9-12 show another exemplary process for forming fluid-handling slots having recessed end regions in a substrate of printhead 114, according to an embodiment of the disclosure. FIGS. 9*a* and 9*b* show partial cross-sectional views of a portion of the printhead 114 of exemplary print cartridge 108 taken along lines a-a and b-b in FIG. 2. More specifically, FIG. 9*a* shows the cross-sectional view along lines a-a, which is the short axis view of the printhead 114, while FIG. 9*b* shows the cross-sectional view along lines b-b, which is the long axis view of the printhead 114.

Figure 9B:
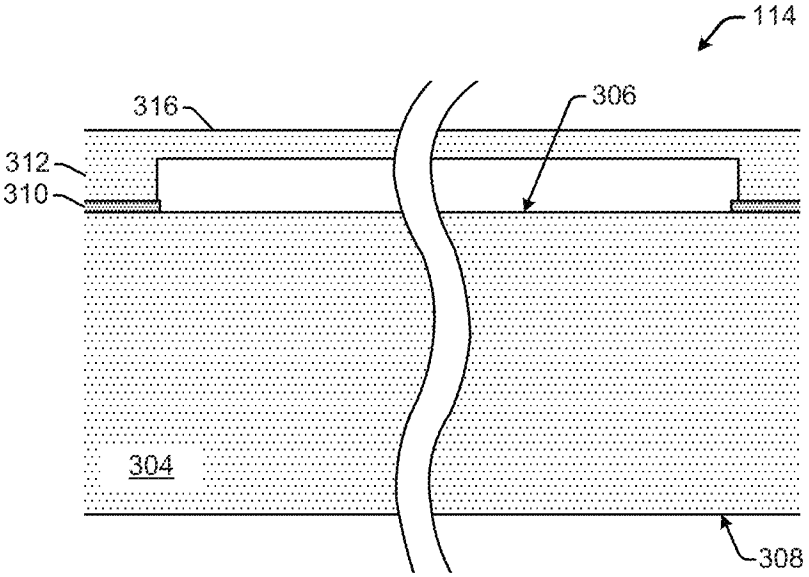
FIGS. 9-12 show another exemplary process for forming fluid-handling slots having recessed end regions in a substrate of printhead, according to an embodiment.
Figure 9A:
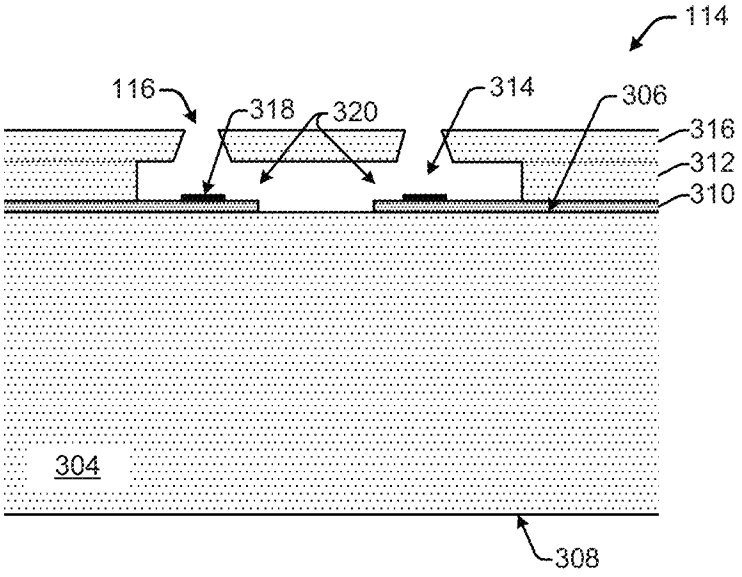

As shown in FIGS. 9*a* and 9*b*, initial steps in an exemplary process of forming fluid-handling slots having recessed end regions in a printhead 114, include processing the front-side surface of substrate 304. This processing is similar to that already discussed above regarding FIGS. 4*a* and 4*b*, and includes forming, over the front-side surface 306, a thin film layer 310, barrier layer 312, orifice layer 316 with nozzles 116, chambers 314 with ejection elements 318, and fluid passageways 320. Unlike the implementation above for FIGS. 4*a* and 4*b*, the present implementation shown in FIGS. 9*a* and 9*b* does not include forming a wet etch masking layer over the back-side surface 308 of substrate 304.

Figure 10B:
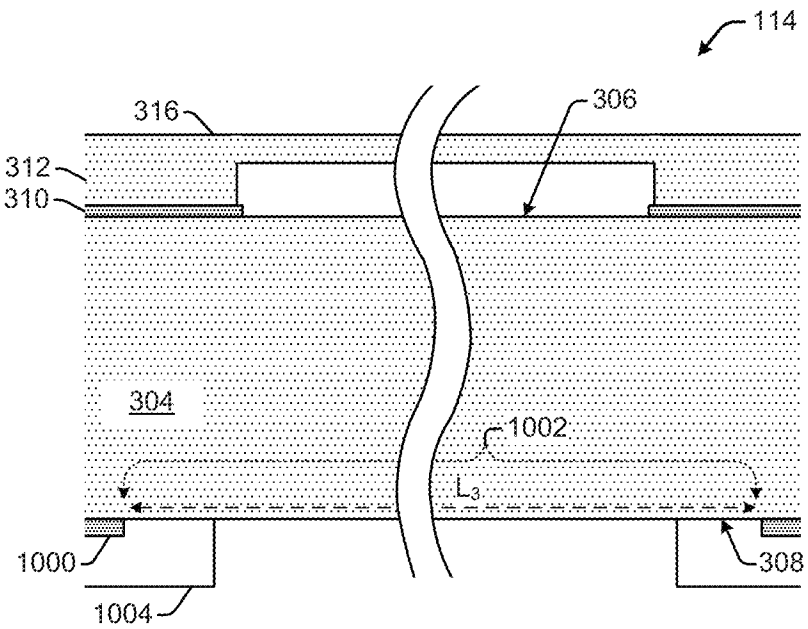
Figure 10A:
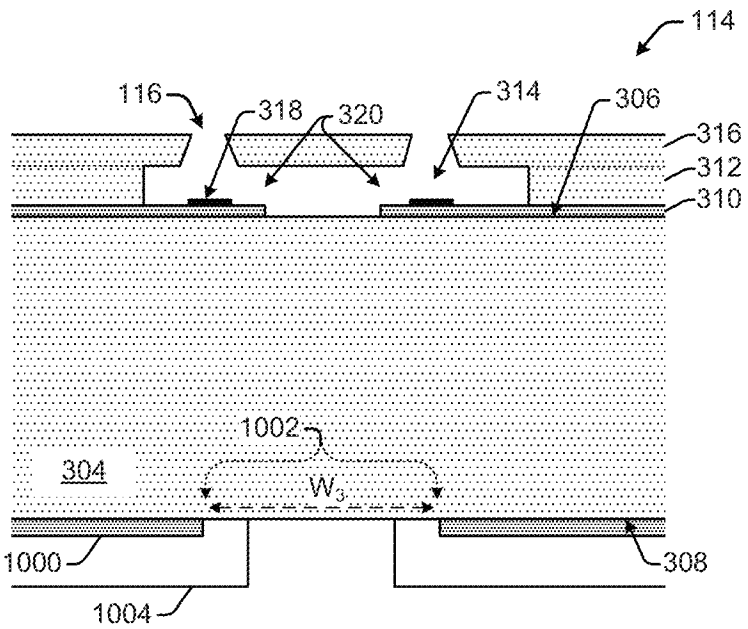

FIGS. 10*a* and 10*b* show additional steps in an exemplary process of forming fluid-handling slots having recessed end regions in a printhead 114. FIG. 10*a* shows the cross-sectional, short axis view of printhead 114 taken along lines a-a of FIG. 2, while FIG. 10*b* shows the cross-sectional, long axis view taken along lines b-b of FIG. 2. As shown in FIGS. 10*a* and 10*b*, two photo mask layers are formed on the back-side surface 308 of substrate 304. A first metal dry etch masking layer 1000 (e.g., aluminum) is deposited and patterned, leaving an exposed area 1002 of the back-side surface 308 of substrate 304. A second dry etch photo mask layer 1004 is deposited over the first masking layer 1000 and over the exposed area 1002. The second dry etch masking layer 1004 can comprise any suitable dry etch resistant material such as a photoresist. The second dry etch masking layer 1004 is then patterned to expose a smaller portion of exposed area 1002, as shown in FIGS. 10*a* and 10*b*. The masking layers 1000 and 1004 can be patterned in any conventional manner.

Figure 11B:
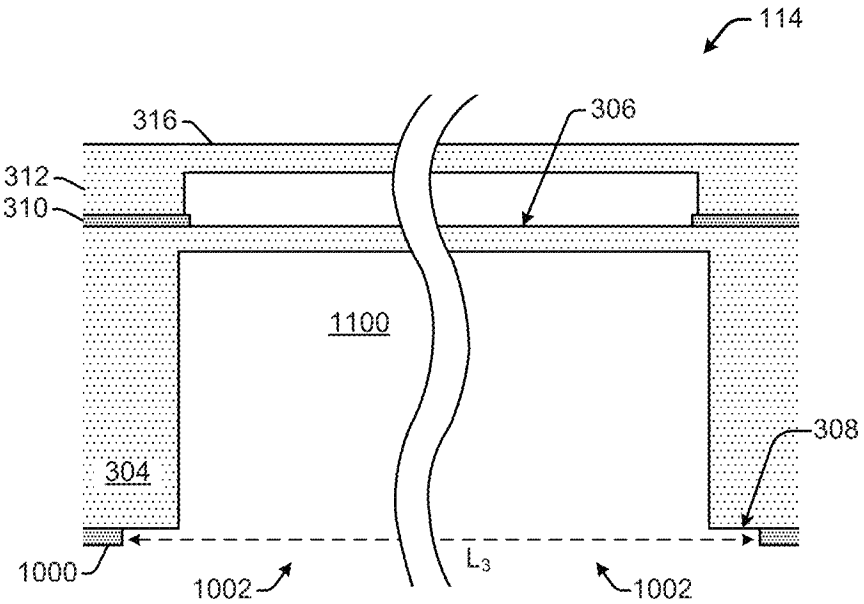
Figure 11A:
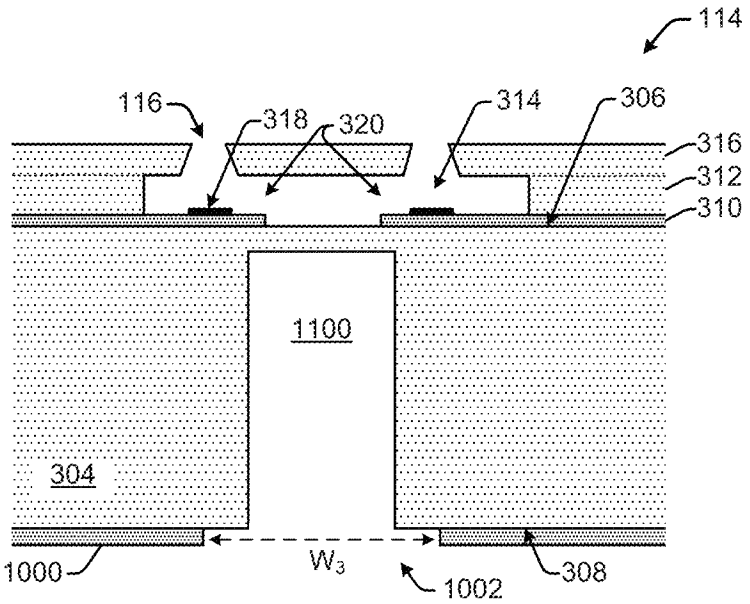

FIGS. 11*a* and 11*b* show additional steps in an exemplary process of forming fluid-handling slots having recessed end regions in a printhead 114. FIG. 11*a* shows the cross-sectional, short axis view of printhead 114 taken along lines a-a of FIG. 2, while FIG. 11*b* shows the cross-sectional, long axis view taken along lines b-b of FIG. 2. As shown in FIGS. 11*a* and 11*b*, a dry etch process is then performed to remove material from the substrate 304 (i.e., to remove silicon), forming a deep trench 1100 in the back-side surface 308 of substrate 304. A suitable dry etch process includes silicon dry etch a plasma enhanced reactive ion etch (RIE) with alternating sulfur hexafluoride (SF6) etching and octafluorobutene (C4F8) deposition. The dimension of the trench 1100 is controlled by the second dry etch masking layer 1004 (FIGS. 10*a*, 10*b*). After the trench 1100 is formed, the second dry etch masking layer 1004 is removed. The first dry etch masking layer 1000 then remains on the back-side surface 308 of substrate 304.

Figure 12B:
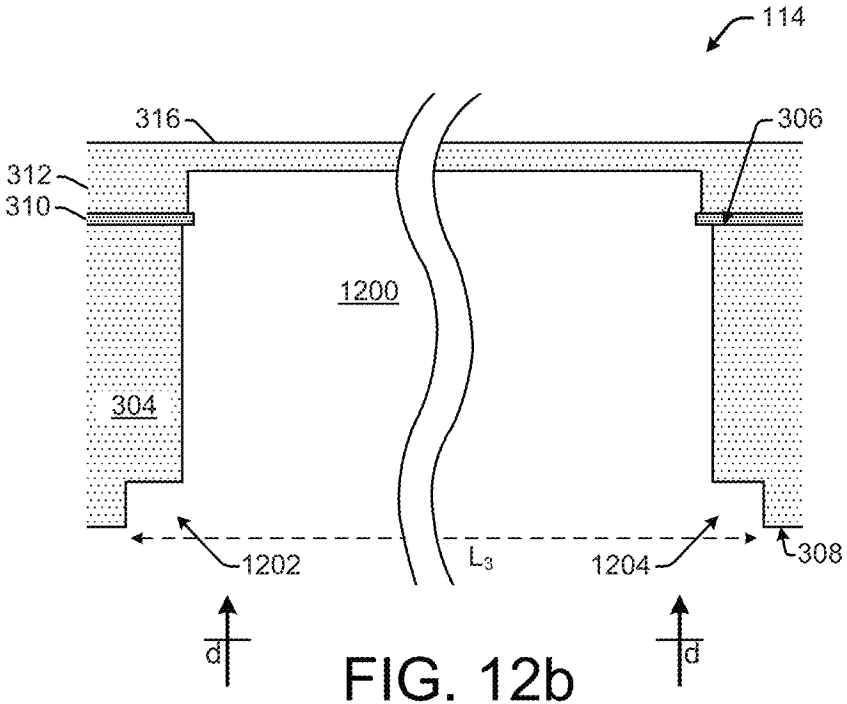
Figure 12A:
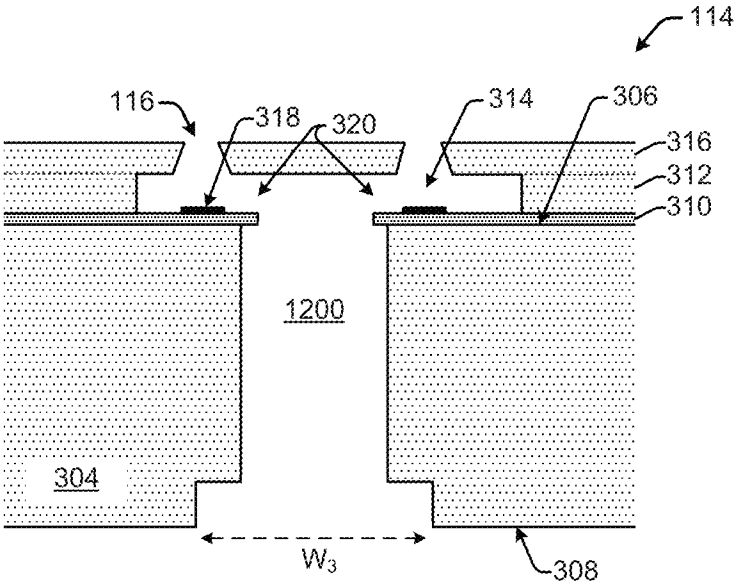

FIGS. 12*a* and 12*b* show additional steps in an exemplary process of forming fluid-handling slots having recessed end regions in a printhead 114. FIG. 12*a* shows the cross-sectional, short axis view of printhead 114 taken along lines a-a of FIG. 2, while FIG. 12*b* shows the cross-sectional, long axis view taken along lines b-b of FIG. 2. As shown in FIGS. 12*a* and 12*b*, using a dry etch process, additional substrate material is removed from within the trench 1100 to form slot 1200 all the way through the substrate 304 from the back-side surface 308 through the front-side surface 306. In addition, as shown in the long axis view of FIG. 12*b*, the dry etch process removes substrate material from portions of the exposed area 1002 (see FIGS. 10*a*, 10*b*) that extend beyond the ends of the slot 1200, which forms the recessed regions 1202 and 1204 into the back-side surface 308 of the substrate 304 at the ends of the slot 1200. The recessed regions 1202 and 1204 extend beyond the length $L_4$ of the slot 1200.

Figure 13A:
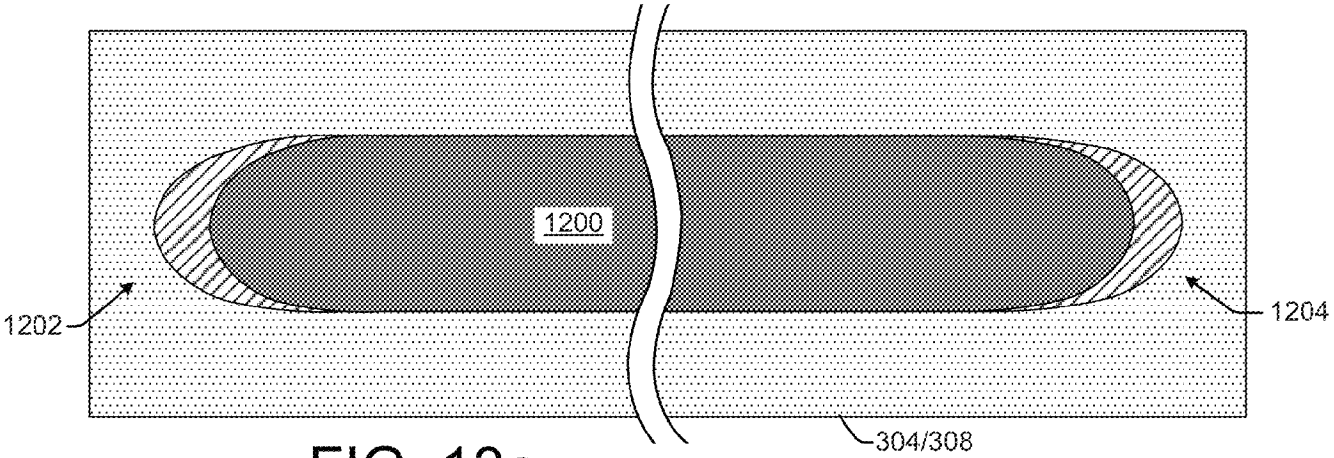
FIGS. 13*a* and 13*b* show plan views from the back side of a substrate illustrating exemplary recessed regions, according to embodiments.
Figure 13B:
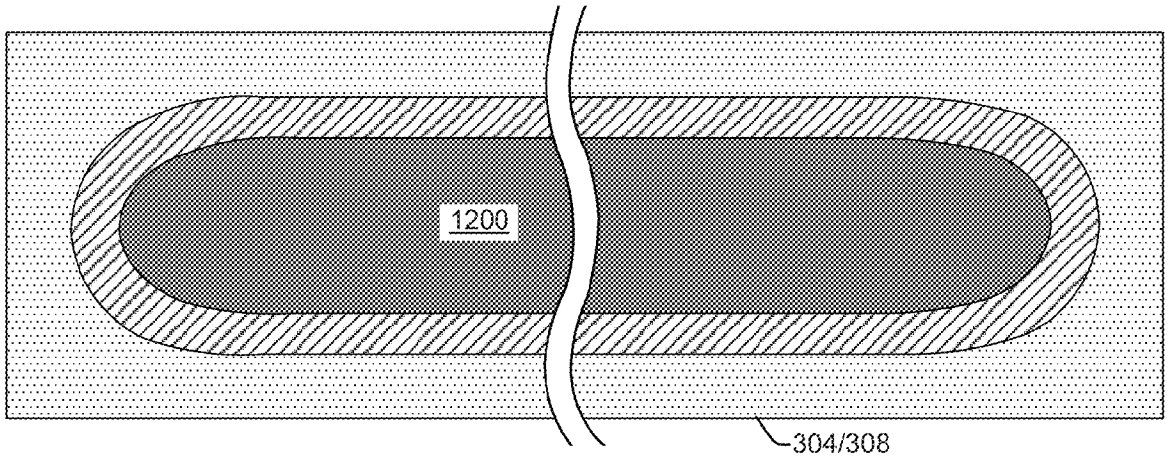

FIGS. 13*a* and 13*b* show plan views from the back side of the substrate 1200 taken from the perspective of the arrows labeled "d" in FIG. 12*b*, illustrating exemplary recessed regions 1202, 1204, according to embodiments of the disclosure. Recessed ends 1202 and 1204 may have shapes that include round or square. The rounded ends shown in FIGS. 13*a* and 13*b* are formed in masking patterns 1000 and 1004 of FIGS. 10*a* and 10*b*. Mask patterns 1000 and 1004 of FIGS. 10*a* and 10*b* are formed with suitable processes such as photolithography, etching or laser patterning.

Figure 14:
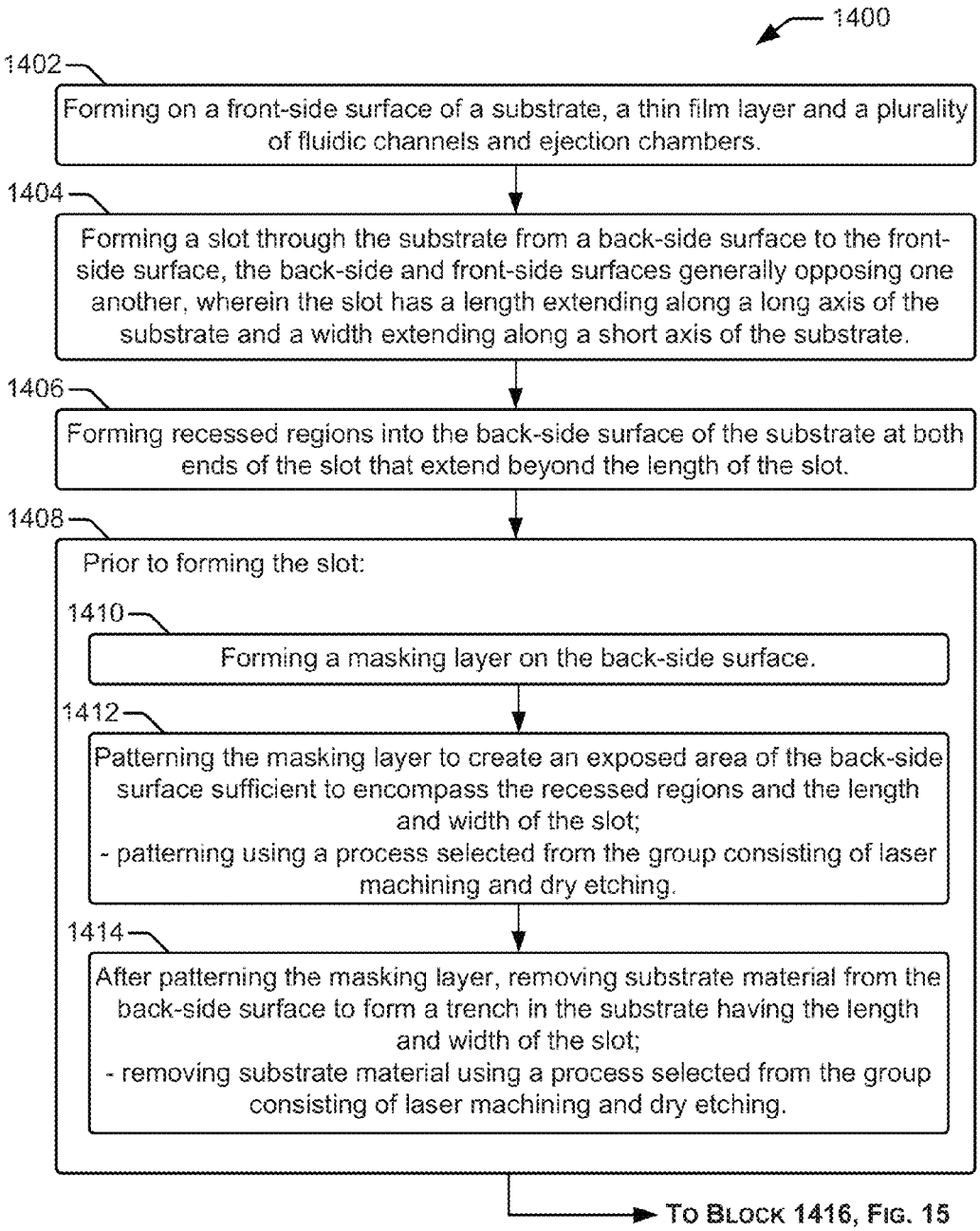
FIGS. 14 and 15 show a flowchart of example methods of forming a printhead having fluid-handling slots with recessed end regions, according to embodiments.

FIG. 14 shows a flowchart of example methods 1400 of forming a printhead having fluid-handling slots with recessed end regions, according to embodiments of the disclosure. Methods 1400 are associated with the embodiments discussed herein with respect to FIGS. 1-13 and generally correspond with the process fabrication steps described above with respect to FIGS. 4-13.

Method 1400 begins at block 1402 with forming on a front-side surface of a substrate, a thin film layer and a plurality of fluidic channels and ejection chambers. At block 1402, the method 1400 continues with forming a slot through the substrate from a back-side surface to the front-side surface. The back-side and front-side surfaces generally oppose one another. The slot has a length extending along a long axis of the substrate and a width extending along a short axis of the substrate. At block 1404, the method 1400 continues with forming recessed regions into the back-side surface of the substrate at both ends of the slot that extend beyond the length of the slot.

Method 1400 continues at block 1408 with steps performed prior to forming the slot. At block 1410, a masking layer is formed on the back-side surface. The method 1400 continues at block 1412 with patterning the masking layer to create an exposed area of the back-side surface sufficient to encompass the recessed regions and the length and width of the slot. The patterning can be achieved using a process such as laser machining and dry etching. At block 1414, the method 1400 continues with, after patterning the masking layer, removing substrate material from the back-side surface to form a trench in the substrate having the length and width of the slot. The substrate material can be removed by laser machining and dry etching processes.

Figure 15:
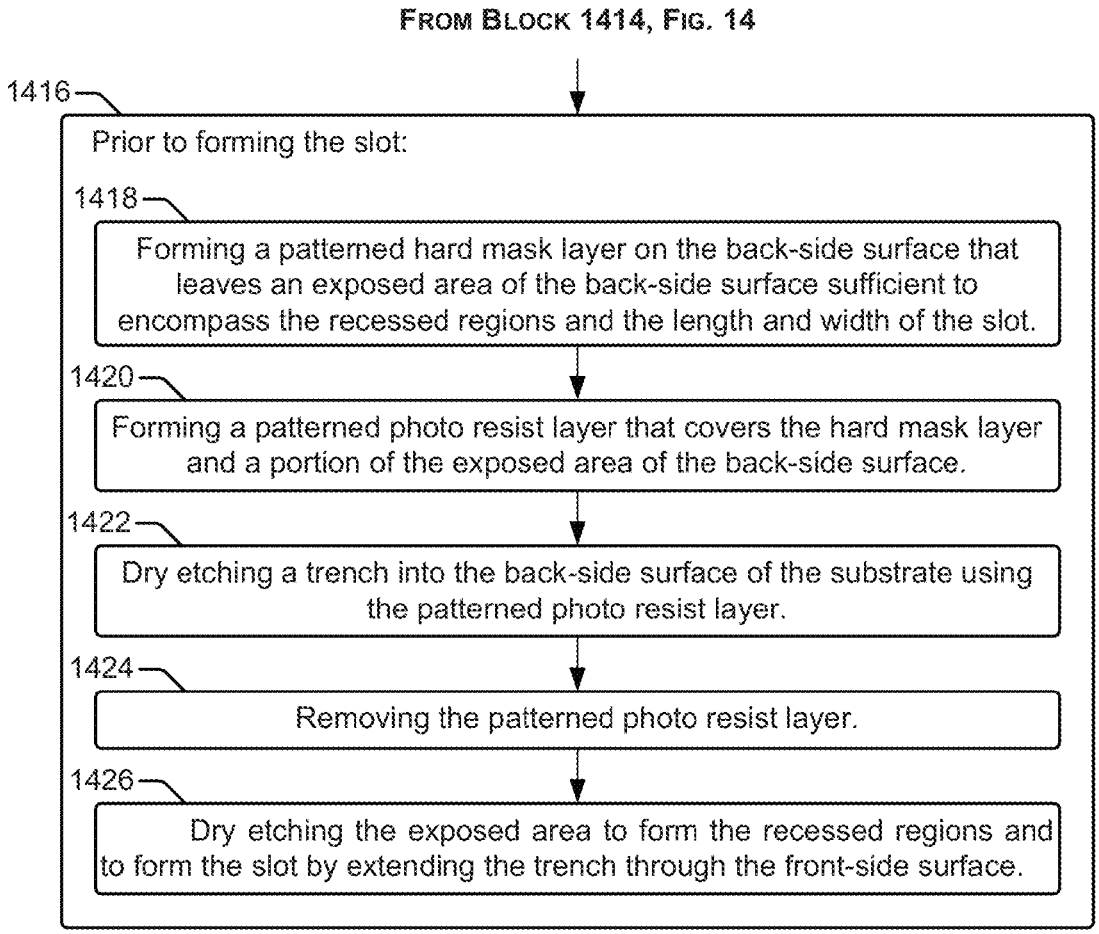

Method 1400 continues on FIG. 15, at block 1416 with steps performed prior to forming the slot. At block 1418, a patterned hard mask layer is formed on the back-side surface that leaves an exposed area of the back-side surface sufficient to encompass the recessed regions and the length and width of the slot. At block 1420, a patterned photo resist layer is formed that covers the hard mask layer and a portion of the exposed area of the back-side surface. The method continues at block 1422 with dry etching a trench into the back-side surface of the substrate using the patterned photo resist layer. At block 1424 the patterned photo resist layer is removed. At block 1426, the method 1400 concludes with, dry etching the exposed area to form the recessed regions and to form the slot by extending the trench through the front-side surface.

What is claimed is:

1. A method of forming a printhead comprising:

forming on a front-side surface of a substrate, a thin film layer and a plurality of fluidic channels and ejection chambers;

forming a masking layer on the back-side surface of the substrate;

forming a slot through the substrate from a back-side surface to the front-side surface, the back-side and front-side surfaces generally opposing one another, wherein the slot has a length extending along a long axis of the substrate and a width extending along a short axis of the substrate;

forming recessed regions into the back-side surface of the substrate at both ends of the slot that extend beyond the length of the slot; and forming a fang feature in a short axis sidewall of the slot, wherein the fang feature is adjacent to the back-side surface, intersects the masking layer at a front-side edge of the masking layer located in the slot, and is an indentation formed by an intersection of two planes, and wherein the intersection of the two planes is in the substrate such that the indentation extends beyond the width of the slot.

2. The method of claim 1, further comprising controlling features of the recessed regions and fang features with a relationship dimension of the masking layer width relative to a deep laser machined location and a wet etch time.

3. The method of claim 1, comprising:

prior to forming the slot, forming a patterned hard mask layer on the back-side surface of the substrate that leaves an exposed area of the back-side surface of the substrate sufficient to encompass the recessed regions and the length and width of the slot; and forming a patterned photo resist layer that covers the hard mask layer and a portion of the exposed area of the back-side surface of the substrate.

4. The method of claim 3, comprising:

dry etching a trench into the back-side surface of the substrate using the patterned photo resist layer; and removing the patterned photo resist layer.

5. The method of claim 3, comprising:

dry etching the exposed area of the back-side surface of the substrate to form the recessed regions and to form the slot by extending the trench through the front-side surface of the substrate.

6. The method of claim 1, comprising forming a recessed end region in the back surface at each end of the slot.

7. The method of claim 6, wherein the recessed end region comprises shapes selected from the group consisting of square shapes and rounded shapes.

8. The method of claim 6, comprising sloping the recessed end region at a single angle from the back surface into the substrate until the recessed end region intersects the slot.

9. The method of claim 6, comprising sloping the recessed end region at multiple angles from the back surface into the substrate until the recessed end region intersects the slot.

10. The method of claim 6, comprising forming a recessed side region in the back surface along both sides of the slot, wherein the recessed end region and recessed side region form a recessed perimeter around the slot.

11. The method of claim 1, comprising:

prior to forming the slot, forming the masking layer on the back-side surface of the substrate; and patterning the masking layer to create an exposed area of the back-side surface of the substrate sufficient to encompass the recessed regions and the length and width of the slot.

12. The method of claim 11, wherein patterning the masking layer comprises patterning using a process selected from the group consisting of laser machining and dry etching.

13. The method of claim 11, comprising:

after patterning the masking layer, removing substrate material from the back-side surface of the substrate to form a trench in the substrate having the length and width of the slot.

14. The method of claim 13, comprising:

after forming the trench, wet etching the exposed area to remove additional substrate material from beyond both ends of the trench and from within the trench to form the recessed regions and the slot extending through to the front-side surface of the substrate.

15. The method of claim 13, wherein removing the substrate material to form the trench comprises removing the substrate material using a process selected from the group consisting of laser machining and dry etching.

16. A method of forming a printhead comprising:

forming on a front-side surface of a substrate, a thin film layer and a fluidic channel and ejection chambers;

forming a masking layer on the back-side surface of the substrate;

forming a slot through the substrate from a back-side surface to the front-side surface, the back-side and front-side surfaces generally opposing one another, wherein the slot has a length extending along a long axis of the substrate and a width extending along a short axis of the substrate, sidewalls of a middle portion of the slot between the opposing front and back surfaces being perpendicular to the opposing front and back surfaces;

forming recessed regions into the back-side surface of the substrate at both longitudinal ends of the slot so that a longitudinal opening of the slot on the back-side of the substrate extends beyond the middle portion the slot interior to the substrate; and forming a fang feature in a short axis sidewall of the slot, wherein the fang feature comprises two planar surfaces and is between the middle portion of the slot and the back-side surface of the substrate and extends laterally into the substrate beyond a sidewall of the middle portion of the slot.

17. The method of claim 16, wherein the slot tapers from the middle portion to a narrower dimension at the front-side surface of the substrate.

18. The method of claim 16, wherein the recessed regions each comprise at least two planar surfaces between the back-side surface of the substrate and the middle portion of the slot.

19. The method of claim 18, wherein the recessed regions each comprise three planar surfaces between the back-side surface of the substrate and the middle portion of the slot.

20. The method of claim 18, wherein the two planar surfaces of the recessed regions form a step between the back-side surface of the substrate and the middle portion of the slot.

* * * * *